US005521469A

United States Patent [19]

Laisné

[11] Patent Number: 5,521,469

[45] Date of Patent: May 28, 1996

[54] COMPACT ISOCHRONAL CYCLOTRON

[76] Inventor: André E. P. Laisné, 7 rue de Couvrechef, 14000 Caen, France

[21] Appl. No.: 240,786

[22] PCT Filed: Nov. 20, 1992

[86] PCT No.: PCT/BE92/00050

§ 371 Date: May 12, 1994

§ 102(e) Date: May 12, 1994

[87] PCT Pub. No.: WO93/10651

PCT Pub. Date: May 27, 1993

[30] Foreign Application Priority Data

Nov. 22, 1991 [BE] Belgium ..... 9101080

[51] Int. Cl.[6] ..... H05H 13/00; H01J 23/00; H01F 1/00; H01F 5/00

[52] U.S. Cl. ..... 315/502; 315/507; 335/216; 335/299

[58] Field of Search ..... 313/62, 507; 315/502; 335/216, 299

[56] References Cited

U.S. PATENT DOCUMENTS 4,771,208 9/1988 Jongen ..... 315/502

4,943,781 7/1990 Wilson ..... 315/507

FOREIGN PATENT DOCUMENTS 8606924 11/1986 Belgium .

9310651 5/1993 Belgium .

*Primary Examiner*—Sandra L. O'Shea

*Assistant Examiner*—John Ning

*Attorney, Agent, or Firm*—Chilton, Alix & Van Kirk

[57] ABSTRACT

A superconducting or non-superconducting compact isochronic cyclotron in which the particle beam is sectorally focused. The cyclotron comprising a solenoid forming a magnetic circuit which is energized by at least one pair of circular main coils surrounding the solenoid poles. The magnetic circuit includes at least three pairs of sectors known as "hills", where the air gap is reduced, separated by sector-shaped spaces known as "valleys", where the air gap is larger. The air gap between the hills has a substantially elliptical curved profile which completely closes off the radial end of the hills at the center plane.

20 Claims, 7 Drawing Sheets

COMPACT ISOCHRONAL CYCLOTRON

SUBJECT OF THE INVENTION

The present invention relates to a cyclotron of novel design in which the particle beam is focused by sectors. More particularly, the present invention relates to an isochronal cyclotron comprising an electromagnet constituting the magnetic circuit which includes at least three pairs of sectors called "hills" where the air gap is smaller, these being separated by spaces in the form of sectors called "valleys" where the air gap has a greater dimension.

The present invention relates more particularly to a compact isochronal cyclotron, that is to say one energized by at least one pair of main circular coils surrounding the poles of the electromagnet.

The present invention relates both to superconducting and non-superconducting cyclotrons.

STATE OF THE ART

Cyclotrons are particle accelerators used in particular for the production of radioactive isotopes.

The cyclotrons are normally composed of three separate main assemblies constituted by the electromagnet, the high-frequency resonator and the vacuum chamber with pumps.

The electromagnet guides the ions over a trajectory representing approximately a spiral of radius which increases during the acceleration.

In modern cyclotrons of the isochronal type, the poles of the electromagnet are divided into sectors having, alternately, a smaller air gap and a larger air gap. The azimuthal variation in the magnetic field which results therefrom has the effect of focusing the beam vertically and horizontally during the acceleration.

Among isochronal cyclotrons, it is convenient to distinguish cyclotrons of the compact type which are energized by at least one pair of main circular coils and cyclotrons called separate-sector cyclotrons where the magnetic structure is divided into entirely self-contained separate units.

First-generation isochronal cyclotrons are cyclotrons which use circular coils of conventional type, that is to say non-superconducting coils. For these first-generation cyclotrons, the mean induction field obtained was limited to values of 1.4 tesla.

One particularly favourable embodiment for a cyclotron of this type is described in Patent Application WO-A-86/06924 where the air gap of the sectors called hills is reduced to a value close to the size of the accelerated beam, whereas the air gap of the sectors called valleys, which separate the hills, is very large so that the magnetic field y is approximately zero.

Another particularly favourable embodiment of an isochronal cyclotron focused by sectors is described in the document WO-A-91/07864 where the hills are coincident with the accelerator system by choosing their configuration and dimensions appropriately.

Both documents have constant air gaps between hills.

The document U.S. Pat. No. 2,872,574 describes an isochronal cyclotron whose air gap between hills has a profile which decreases linearly. This cyclotron is intended for accelerating particles up to a few tens of MeV proton.

The document IEEE Transaction on Nuclear Science (Vol. NS-32, No. 5/2, October 1985, NY-US, pp. 3316–3317) describes a compact isochronal cyclotron enabling $H^-$ particles to be accelerated up to an energy of 30 MeV for magnetic inductions between the hills of the order of 1.7 tesla, and in which the air gap between hills has a profile which increases up to a maximum value and decreases beyond that.

Over the last twenty years, cyclotrons called second-generation cyclotrons have appeared which use superconductor technologies. In these cyclotrons, the main coils are of the superconducting type and enable mean inductions lying between 1.7 and 5 tesla to be obtained, which makes it possible to deliver particle beams having magnetic strengths (Br) markedly greater than those delivered by first-generation cyclotrons.

However, because of the higher inductions obtained, the number of accelerating cavities had to be increased as far as possible so as to prevent the beam from having to execute too great a number of revolutions within the cyclotron. The reason for this is that, when the beam has to perform a high number of revolutions, this requires increased precision in producing the magnetic field and, in this case, it is preferred to use all the valleys to house the accelerating cavities therein.

Consequently, the extraction devices in superconducting isochronal cyclotrons are in-hill rejected, which markedly complicates the extraction. A second drawback, due to the fact that high fields are obtained for superconducting cyclotrons, is that the extraction devices constituted by an electrostatic channel and/or an electromagnetic channel have seen their relative efficiency decreased and consequently second-generation cyclotrons require extraction devices which are much more complex than those of first-generation cyclotrons.

In particular, the extraction devices of the known second-generation cyclotrons have the feature that they occupy almost an entire machine revolution along which may be numbered two to three extractors followed by three to ten focusing elements.

In all compact isochronal cyclotrons having superconducting or non-superconducting coils, in which the air gap between two hills is essentially constant, a decrease in the induction is observed which is felt as from the first two thirds of the pole radius and which falls to half of its maximum value at the radial extremity of the hills (hill radius).

A first solution to prevent this decrease was proposed by choosing an appreciably greater pole radius than that at which the maximum energy is achieved, but as a result, the radial zone where the magnetic field continues to increase without being isochronal was also lengthened; this magnetic field passes through a maximum and decreases beyond that. The extension of this radial edge-field zone will also markedly complicate the extraction.

OBJECTIVES OF THE INVENTION

The present invention aims to propose a novel configuration of superconducting or non-superconducting compact isochronal cyclotron not having the drawbacks of the prior art.

A first objective of the present invention aims to provide a superconducting or non-superconducting compact isochronal cyclotron which tends to prevent the attenuation of the vertical component of the induction when the radial extremity of the poles is approached.

In particular, the present invention aims to provide an isochronal cyclotron where the non-utilizable field zone at the extremity of the poles is reduced to a few millimeters.

A complementary objective of the present invention is to propose a cyclotron which has a simplified extraction device, in particular in the case of a superconducting cyclotron.

Other objectives and advantages will appear in the description which follows.

MAIN CHARACTERISTIC ELEMENTS OF THE PRESENT INVENTION

The present invention relates to a superconducting or non-superconducting compact isochronal cyclotron in which the particle beam is focused by sectors, comprising an electromagnet constituting the magnetic circuit which includes at least three pairs of sectors called "hills" where the air gap is reduced, these being separated by spaces in the form of sectors called "valleys" where the air gap has a greater dimension and which is energized by at least one pair of main circular coils surrounding the poles of the electromagnet, this cyclotron being characterized in that the air gap of the hills has an essentially elliptical changing profile which tends towards complete closure at the radial extremity of the hills (hill radius) on the mid-plane and which, more particularly, totally closes up on the mid-plane.

By the expression "tends towards complete closure" is meant the configurations where a small residual opening (preferably less than the vertical dimension of the accelerated beam) remains and the configurations where the closure of the elliptical profile of the air gap is complete in the mid-plane.

According to this latter configuration of the air gap of the hills (complete closure of the air gap), perfect continuity of the induction over the entire radial extent of the hills is theoretically obtained in the case where the magnetization of the iron is uniform (constant modulus and constant direction), and this is so even in the case where the pole radius is equal to the hill radius.

In practice, with soft iron, this state of uniformity of the magnetization is achieved when the iron of the hills works at saturation, that is to say when the induction in the iron of the hills is greater than 2.2 tesla. In the case where the pole radius is approximately (to within 1 mm) equal to the hill radius, perfect continuity of the induction in the air gap is then achieved over virtually the entire extent of the air gap of the hills.

Nevertheless, there still remains a rise in the induction in the vicinity of the hill radius, because of the non-uniformity of the magnetization vector of the iron in the vicinity of this hill radius.

In order to prevent this phenomenon, provision is made to produce a closure of the air gap in the mid-plane in the form of a magnetic shunt between each pair of hills. This shunt preferably has a radial thickness lying between 2 and 10 mm so as to increase by this amount the pole radius with respect to the hill radius.

The closure of the air gap in the region of the shunt must not be complete; in fact, it suffices for the residual air gap to remain small compared to the vertical dimension of the accelerated beams.

In addition to the fact that, according to this configuration, virtual perfect continuity of the internal induction is reestablished up to the hill radius, an extremely rapid decrease in the induction is also observed outside, beyond the hill radius, which enables the system for extracting the particle beam to be greatly simplified.

BRIEF DESCRIPTION OF THE FIGURES

The present invention will be better described with the aid of the appended figures in which.

DESCRIPTION OF A PREFERRED EMBODIMENT OF A CYCLOTRON ACCORDING TO THE INVENTION

Figure 1:
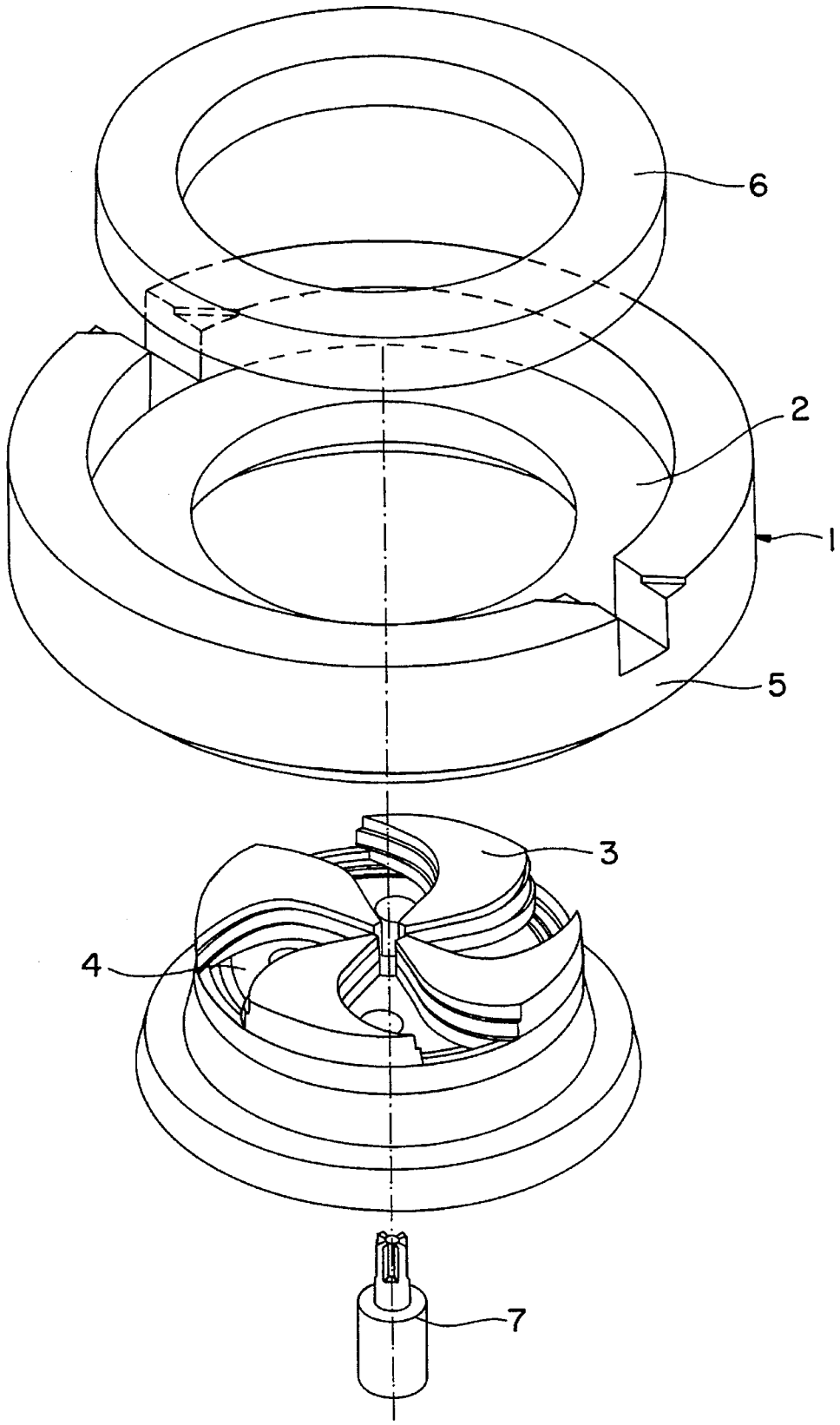
FIG. 1 represents, diagrammatically, an exploded view of the main elements constituting the lower half of a compact isochronal cyclotron.

The cyclotron shown diagrammatically in FIG. 1 is a cyclotron intended for accelerating protons up to an energy of 230 MeV.

The magnetic structure 1 of the cyclotron is composed of a certain number of elements 2, 3, 4 and 5, made of a ferromagnetic material, and of coils 6 made of a preferably conducting or superconducting material.

The ferromagnetic structure consists:

of two base plates 2 and 2' called yokes;

of at least three upper sectors 3 called hills and of the same number of lower sectors 3' (see FIG. 2) which are located symmetrically, with respect to a plane of symmetry 10 called the mid-plane, with the upper sectors 3 and which are separated by a small air gap 8; between two consecutive hills there exists a space where the air gap has a greater dimension and which is called a "valley" 4; and of at least one flux return 5 connecting, in a rigid way, the lower yoke 2 to the upper yoke 2'.

The coils 6 have an essentially circular shape and are located in the annular space left between the sectors 3 or 3' and the flux returns 5.

These coils may be made of a superconducting material, but, in this case, it will be necessary to provide the necessary cryogenic devices.

The central conduit is intended to receive, at least in part, the source 7 of particles to be accelerated, these being injected at the centre of the apparatus via means known per se.

Figure 2:
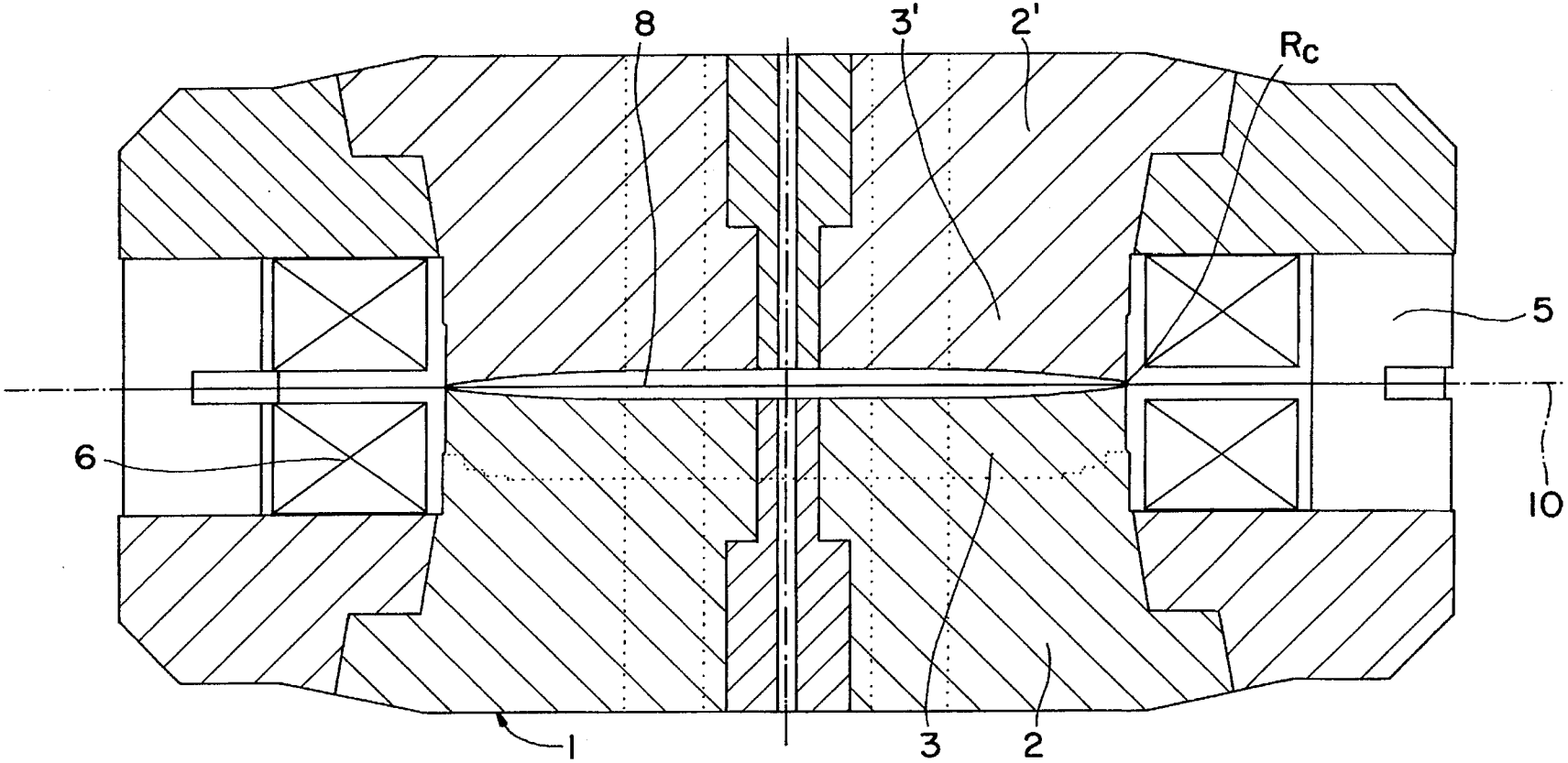
FIG. 2 represents a sectional view of a cyclotron according to the present invention.

FIG. 2 represents a sectional view of a cyclotron according to the present invention.

The essential characteristic of the cyclotron according to the present invention is constituted by the fact that the air gap 8 located between two hills 3 and 3' has an essentially elliptical changing profile which tends to close up on the mid-plane 10 at the radial extremity of the hills, called the hill radius $R_c$.

Preferably, the closure is complete at the radius $R_c$ or at the very least the residual air gap is less than the vertical dimension of the beam.

Figure 3:
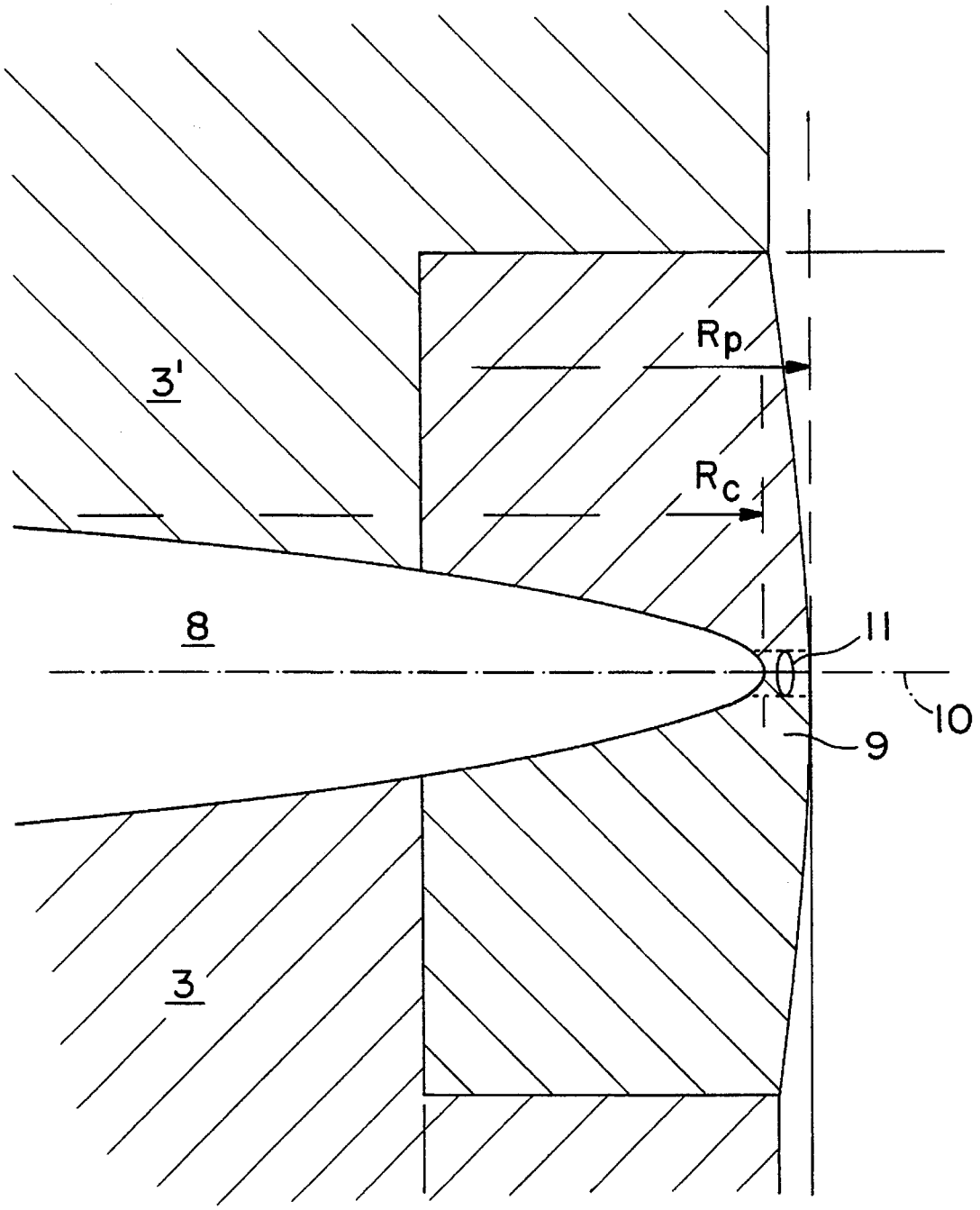
FIG. 3 represents a more detailed view of an air gap between two hills having the essential characteristics of the present invention.

According to a further preferred embodiment, shown in FIG. 3, a magnetic shunt 9 has been placed, beyond the hill radius $R_c$, between each pair of hills 3 and 3', which is in the form of a metal screen having a radial thickness lying between 2 and 10 mm and preferably of the order of 6.5 mm.

In this case, the pole radius $R_p$ and the hill radius $R_c$ are no longer coincident, the pole radius lying, of course, at the radial extremity of the magnetic shunt.

It is obvious that at least one magnetic shunt 9 is equipped with .at least one opening 11 in order to enable the extracted beam to pass. Preferably, it is constructed obliquely with respect to the hill radius.

FIGS. 4 to 11 represent the vertical component $B_z$ of the induction as a function of the radius $\gamma$ in the case of a uniform magnetization M.

Figure 4:
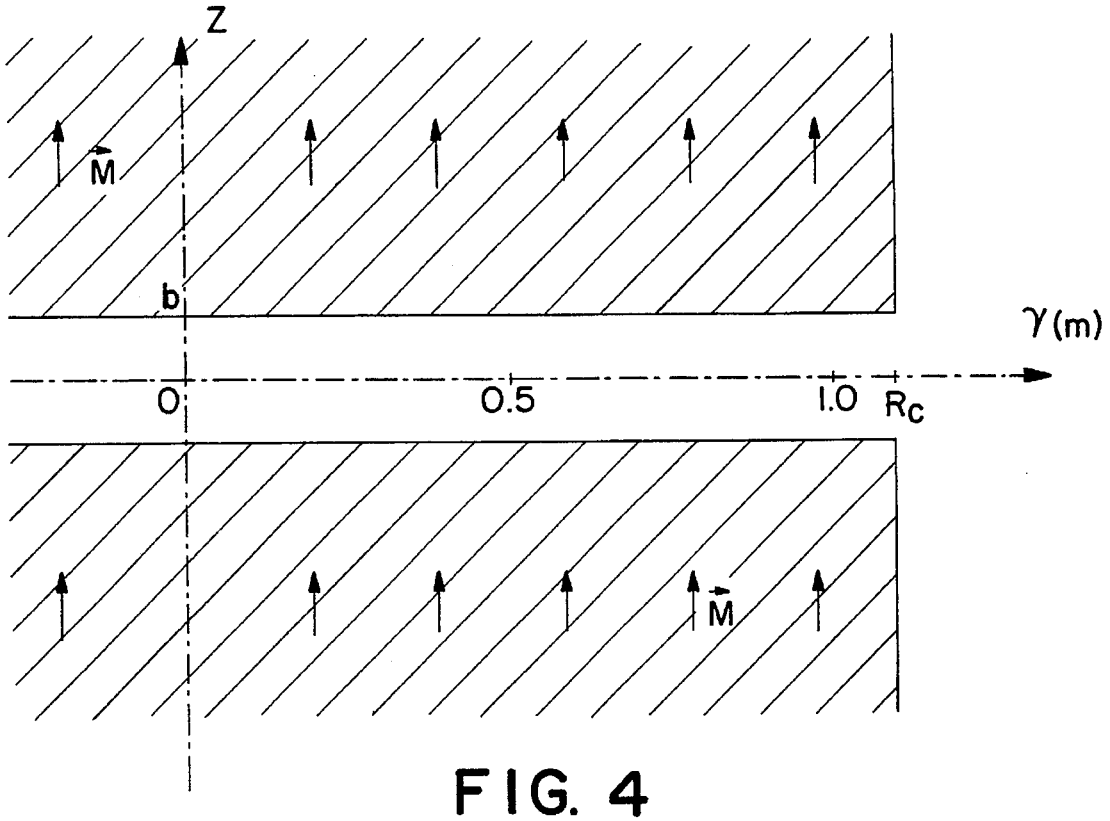
FIGS. 4 to 11 are graphical representations of the value of the vertical component of the induction as a function of the radius at the mid-plane of the air gap located between two hills for a cyclotron of the prior art (FIGS. 4 and 5) or according to a cyclotron of the present invention (FIGS. 6 to 11).
Figure 5:
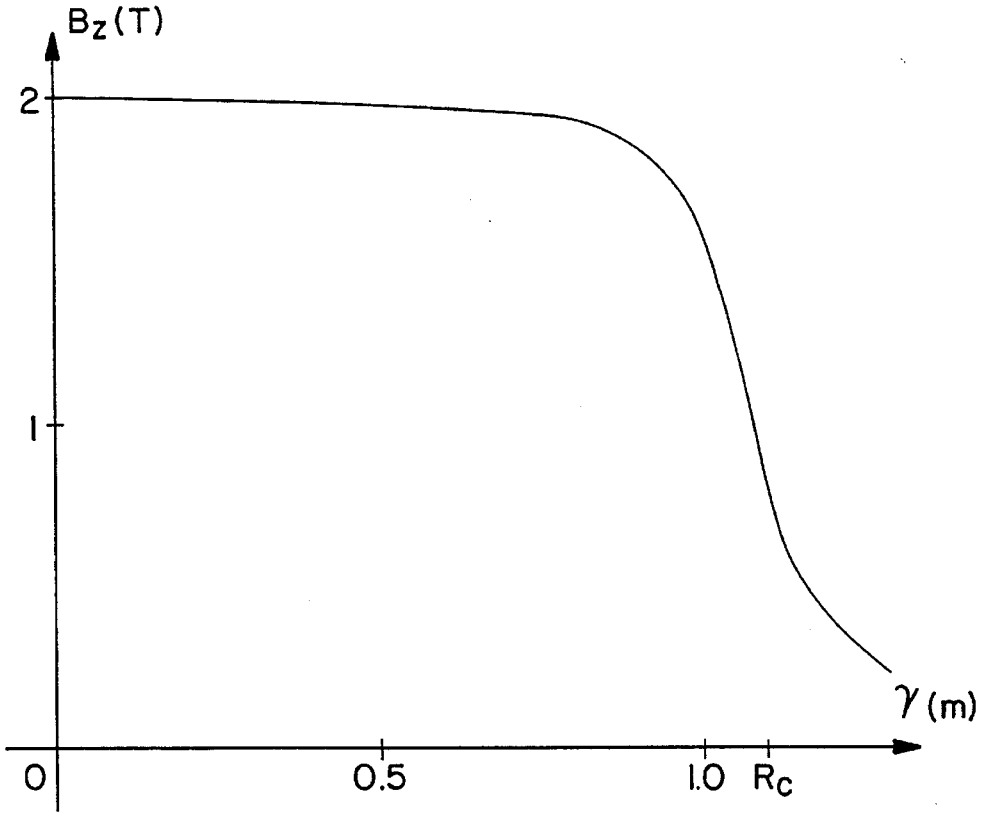

FIGS. 4 and 5 represent this variation in the case of a constant air gap b between two hills, as this is the case for a cyclotron according to the prior art.

It is observed that, in this case, the vertical induction $B_z$ decreases rapidly as a function of the radius $\gamma$ and this is so already for a value markedly less than the pole radius $R_p$.

This decrease is already felt as from the first two thirds of the pole radius and falls to half of its maximum value at the hill radius $R_c$.

Figure 6:
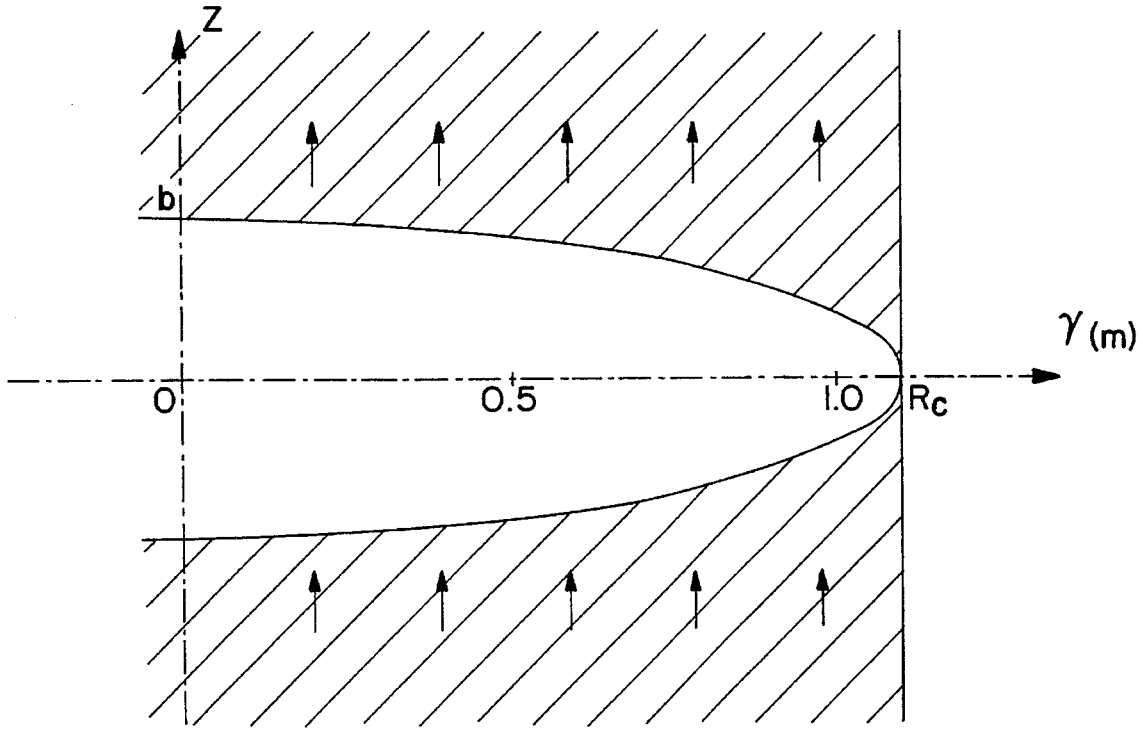
Figure 7:
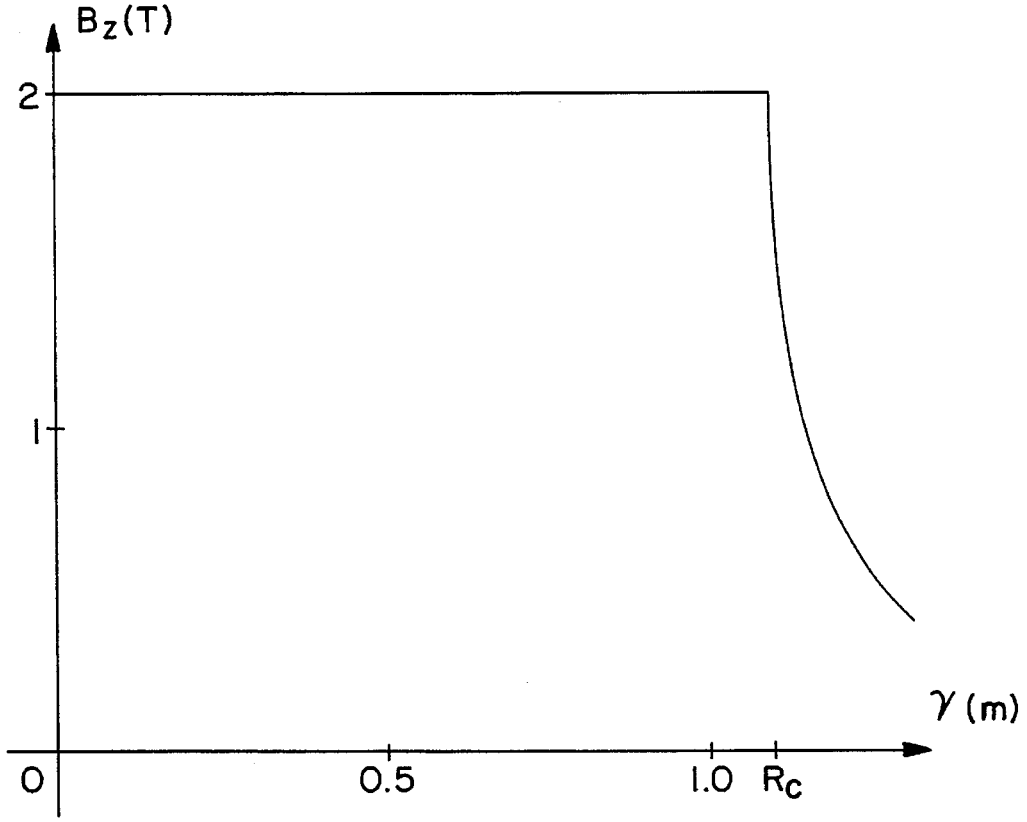

FIGS. 6 and 7 represent the variation in the magnetic induction $B_z$ as a function of the radius $\gamma$ in the case where the air gap has an elliptical shape closing up completely at the pole radius $R_c$, in the theoretical case of a uniform magnetization M.

In this theoretical case, perfect continuity of the induction is observed for any radial distance less than the radius $R_c$ and an extremely rapid decrease beyond $R_c$, even in the case where $R_p$ equals $R_c$.

Figure 8:
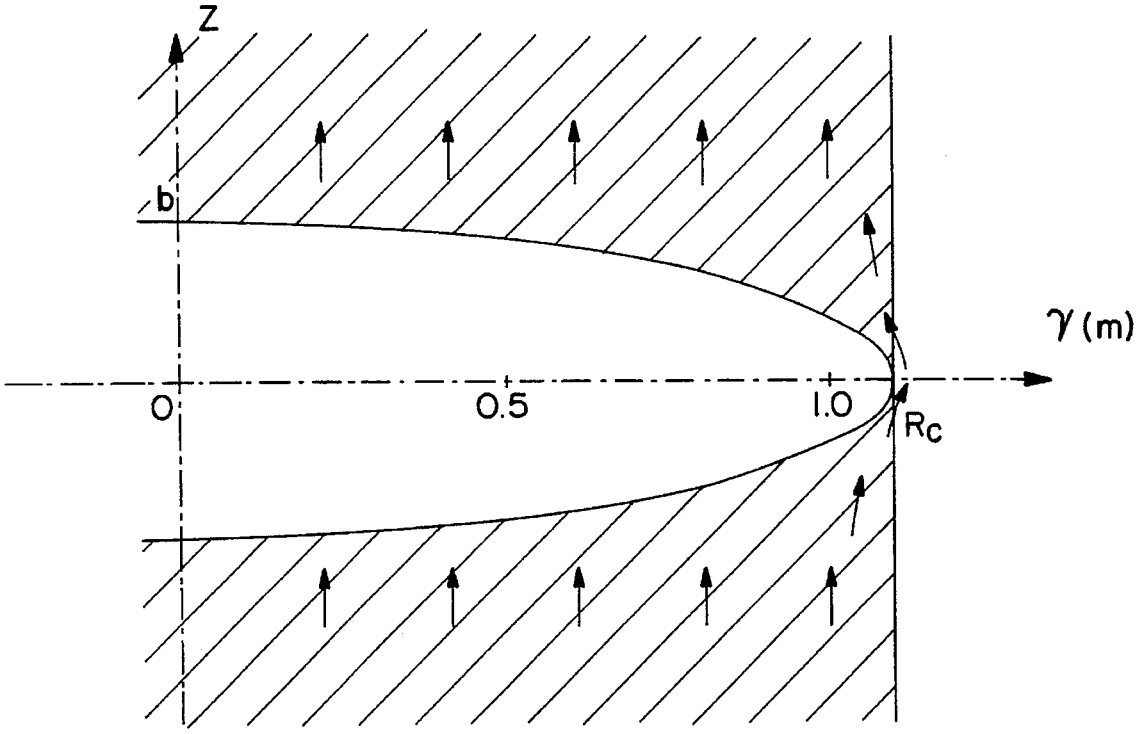
Figure 9:
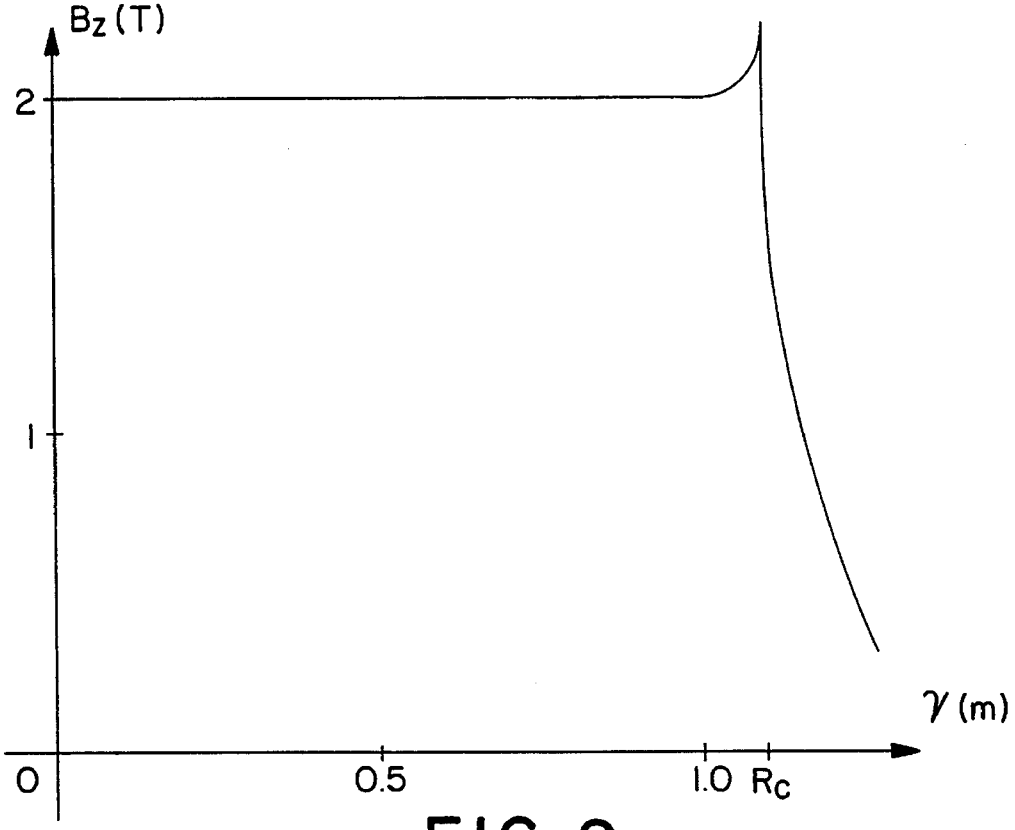

Nevertheless, as already mentioned previously, this case is theoretical; in reality, with soft iron, a non-uniformity of the magnetization M is obtained in the vicinity of the pole radius $R_p$, which consequently generates a rise in the induction, such as shown in FIGS. 8 and 9.

Figure 10:
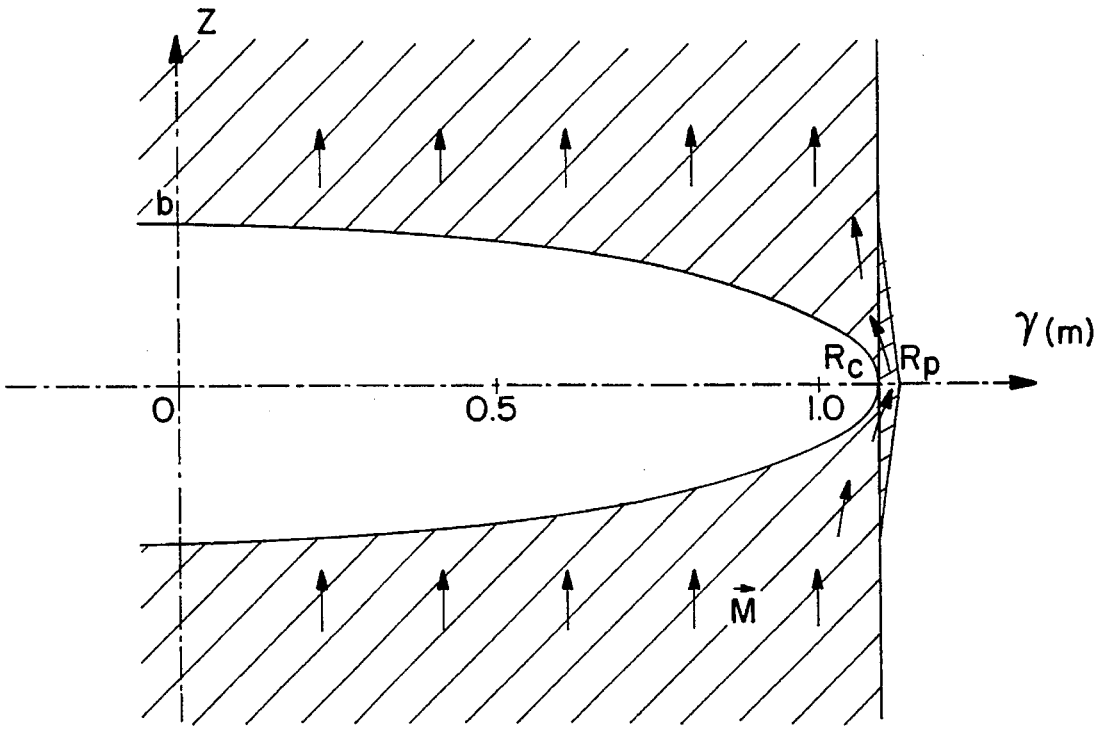
Figure 11:
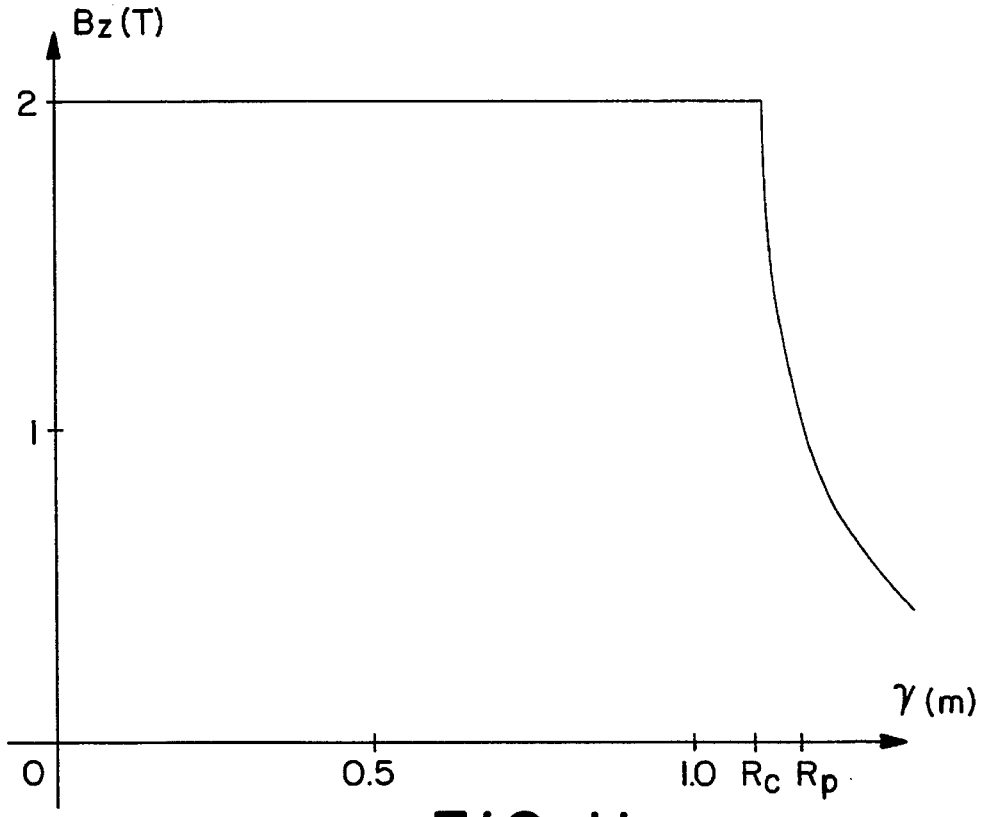

In order to avoid this undesirable effect, a magnetic shunt should be introduced which obstructs the mid-plane and thus makes it possible to reestablish the uniformity of the magnetization and, consequently, the virtually perfect continuity of the vertical induction for a radius less than the radius $R_c$, as appears in FIGS. 10 and 11.

It should be noted that the value of the vertical component $B_z$ (r) of the magnetostatic induction for a radius less than the radius $R_c$ essentially depends on the value of the minor half-axis (b) of the ellipse generating the profile of the air gap formed between two hills.

The main advantage of this configuration of the air gap for a cyclotron according to the present invention resides in the fact that the system for extracting the particle beamwill be greatly simplified compared to the extraction system for cyclotrons according to the state of the prior art.

In particular, a cyclotron according to the present invention, which is intended to accelerate protons to an energy greater than 150 MeV, may possess an extraction system composed solely of a single electrostatic deflector followed by two or three focusing magnetostatic channels.

In the present case, these magnetostatic channels consist of soft-iron bars having a rectangular cross-section of small dimension and consequently have a very low production cost.

In general, a cyclotron according to the present invention has the advantage of a reduction in the volume of iron necessary for producing the poles of the yoke compared to those of a cyclotron according to the prior art.

I claim:

1. A compact isochronal cyclotron in which the particle beam is focused by sectors, comprising an electromagnet having two poles, said poles defining a mid-plane and constituting a magnetic circuit which includes at least three pairs of sectors (3 and 3') called "hills" where the air gap is reduced, these being separated by spaces in the form of sectors (4) called "valleys" where the air gap has a greater dimension and which is energized by at least one pair of main circular coils (6) surrounding the poles of the electromagnet, this cyclotron being characterized in that the air gap (8) located between the two hills (3 and 3') has an essentially elliptical changing profile which tends towards complete closure at the radial extremity of the hills, called the hill radius ($R_c$), on the mid-plane (10).

2. Cyclotron according to claim 1, characterized in that the air gap (8) between two hills (3 and 3') closes up completely at the hill radius ($R_c$) on the mid-plane (10).

3. Cyclotron according to claim 1, characterized in that the air gap (8) between two hills (3 and 3') has a slight opening, at the hill radius ($R_c$), preferably less than the vertical dimension of the beam to be extracted.

4. Cyclotron according to claim 2, characterized in that a magnetic shunt (9) produced in continuity with the poles of the electromagnet is placed between each pair of hills (3 and 3') beyond the radial extremity ($R_c$) of the hills.

5. Cyclotron according to claim 4, characterized in that at least one magnetic shunt (9) is equipped with at least one opening (11) so as to enable the extracted beam to pass.

6. Cyclotron according to claim 4, characterized in that the magnetic shunts (9) are in the form of a metal screen having a thickness lying between 2 and 10 mm and preferably of the order of 6.5 mm.

7. Cyclotron according to claim 1, characterized in that the extraction system associated with the cyclotron is composed of a single electrostatic deflector followed by preferably two or three focusing electrostatic channels.

8. A method for accelerating protons to an energy greater than 150 MeV comprising subjecting the protons to a magnetic field provided by a magnetic circuit which includes at least three pairs of sectors (3 and 3') called "hills" where the air gap is reduced, these being separated by spaces in the form of sectors (4) called "valleys" where the air gap has a greater dimension and which is energized by at least one pair of main circular coils (6) surrounding the poles of the electromagnet, said poles defining a mid-plane, this cyclotron being characterized in that the air gap (8) located between two hills (3 and 3') has an essentially elliptical changing profile which tends towards complete closure at the radial extremity of the hills, called the hill radius ($R_c$), on the mid-plane (10).

9. Cyclotron according to claim 3, characterized in that a magnetic shunt (9) produced in continuity with the poles of the electromagnet is placed between each pair of hills (3 and 3') beyond the radial extremity ($R_c$) of the hills.

10. Cyclotron according to claim 9, characterized in that at least one magnetic shunt (9) is equipped with at least one opening (11) so as to enable the extracted beam to pass.

11. Cyclotron according to claim 5, characterized in that the magnetic shunts (9) are in the form of a metal screen having a thickness lying between 2 and 10 mm and preferably of the order of 6.5 mm.

12. Cyclotron according to claim 10, characterized in that the magnetic shunts (9) are in the form of a metal screen having a thickness lying between 2 and 10 mm and preferably of the order of 6.5 mm.

13. Cyclotron according to claim 2, characterized in that the extraction system associated with the cyclotron is composed of a single electrostatic deflector followed by preferably two or three focusing electrostatic channels.

14. Cyclotron according to claim 3, characterized in that the extraction system associated with the cyclotron is composed of a single electrostatic deflector followed by preferably two or three focusing electrostatic channels.

15. Cyclotron according to claim 4, characterized in that the extraction system associated with the cyclotron is composed of a single electrostatic deflector followed by preferably two or three focusing electrostatic channels.

16. Cyclotron according to claim 5, characterized in that the extraction system associated with the cyclotron is composed of a single electrostatic deflector followed by preferably two or three focusing electrostatic channels.

17. Cyclotron according to claim 6, characterized in that the extraction system associated with the cyclotron is composed of a single electrostatic deflector followed by preferably two or three focusing electrostatic channels.

18. Cyclotron according to claim 9, characterized in that the extraction system associated with the cyclotron is composed of a single electrostatic deflector followed by preferably two or three focusing electrostatic channels.

19. Cyclotron according to claim 10, characterized in that the extraction system associated with the cyclotron is composed of a single electrostatic deflector followed by preferably two or three focusing electrostatic channels.

20. Cyclotron according to claim 11, characterized in that the extraction system associated with the cyclotron is composed of a single electrostatic deflector followed by preferably two or three focusing electrostatic channels.

* * * * *